US005997459A

United States Patent [19]

Krüger et al.

[11] Patent Number: 5,997,459

[45] Date of Patent: Dec. 7, 1999

[54] DEVICE FOR PROCESSING A BLANK TRANSPORTED ALONG A CONVEYOR PATH AT A PREDETERMINED CONVEYING SPEED

[75] Inventors: Karl Heinz Krüger, Remscheid; Manfred Pszak, Wermelskirchen, both of Germany

[73] Assignee: Alfred Klett KG, Remscheid, Germany

[21] Appl. No.: 08/836,846

[22] PCT Filed: Nov. 6, 1995

[86] PCT No.: PCT/EP95/04368

§ 371 Date: May 2, 1997

§ 102(e) Date: May 2, 1997

[87] PCT Pub. No.: WO96/14204

PCT Pub. Date: May 17, 1996

[30] Foreign Application Priority Data

Nov. 6, 1994 [DE] Germany ..... 44 39 198

[51] Int. Cl.[6] ..... B31F 1/30

[52] U.S. Cl. ..... 493/441; 493/161; 493/179; 493/182; 493/399; 493/423

[58] Field of Search ..... 493/402, 401, 493/400, 399, 398, 397, 396, 161, 182, 181, 179, 178, 423, 441

[56] References Cited

U.S. PATENT DOCUMENTS

| | | | |
|---|---|---|---|
| 1,144,765 | 6/1915 | Kelleher | 493/402 |
| 1,414,549 | 5/1922 | Cleary et al. . | |
| 3,122,069 | 2/1964 | Lopez . | |
| 4,614,512 | 9/1986 | Capdeboscq | 493/179 |
| 4,624,653 | 11/1986 | McBride et al. | 493/179 |
| 5,092,827 | 3/1992 | McAdam, III et al. | 493/179 |
| 5,207,632 | 5/1993 | Brunlid | 493/396 |

FOREIGN PATENT DOCUMENTS

| | | |
|---|---|---|
| 0 388 649 A1 | 9/1990 | European Pat. Off. . |
| 94 06 215 U | 9/1994 | Germany . |

*Primary Examiner*—Linda Johnson
*Assistant Examiner*—Matthew Luby
*Attorney, Agent, or Firm*—Herbert Dubno

[57] ABSTRACT

The present invention relates to a folding machine for folding the side flaps flanking the middle section of a foldable cardboard blank. For this purpose in the frontal area of the folding machine auxiliary folding devices are arranged. In addition turning belts for the inward tilting of the side flaps can be arranged, which are provided with projections insuring that the side flaps are swung parallelly to their folding grooves.

12 Claims, 9 Drawing Sheets

DEVICE FOR PROCESSING A BLANK TRANSPORTED ALONG A CONVEYOR PATH AT A PREDETERMINED CONVEYING SPEED

CROSS REFERENCE TO RELATED APPLICATIONS

This application is a national stage of PCT/EP 95/04368 filed Nov. 6, 1995 and based, in turn, upon German National Application P 44 39198 of Nov. 6, 1994.

The invention relates to a device for processing a blank transported along a conveyor path at a predetermined conveying speed.

BACKGROUND OF THE INVENTION

The invention relates to a special construction of a folding machine for the production of foldable containers from a blank transported along a conveyor path with predetermined conveying speed, whose middle part has laterally arranged hinge-like folding grooves with thereto adjoining side flaps, which along their conveying path are first raised from their flattened position by means of turning devices, increasingly tilted inwardly along the folding grooves towards the longitudinal median of the blank, and finally folded together from above and connected to each other.

Such devices, which are special folding machines, are known (see e.g. the brochure "In-Line Machine 2000", Klett Wellpappenmaschinen, Remscheid Germany).

Throughout the present application the terms "device for processing a blank transported along a conveyor path at a predetermined conveying speed" and "folding machine" are used as synonyms, since all features on which the invention is based apply to such a device, as well as to this type of folding machine.

Although the present invention generally relates to a folding machine for the production of foldable containers of a flat material blanks, a preferred embodiment of the present invention is a folding machine for the production of foldable boxes made of foldable cardboard. Particularly corrugated cardboard is used as a starting material.

However we do not intend to limit the invention to blanks of corrugated cardboard. Therefore corrugated cardboard and foldable cardboard are used when no special indication is given. A foldable cardboard comprises also the general concept of foldable container, as long as the foldable container is produced in a folding machine as described by the invention.

Such foldable cardboard blanks consist for instance of corrugated cardboard. For this purpose for each foldable box a corrugated cardboard sheet is provided with a groove parallel to the undulation, hinge-like side flaps adjoin the middle part.

The present invention is not limited to folding machines for the production of foldable containers closed on all sides. It relates also to folding machines for the production of shell-like folding containers. This are for instance protective casings without a top and/or bottom. The problem with such protective casings is that the surrounded object has to fit as accurately as possible within the casing. By eliminating the bottom and/or the top the danger of unintended slide-out of the object exists.

In practice a relevant case occurs e.g. with the casing of headlights for motor vehicles. This headlights are usually fitted in corrugated cardboard jackets. The inner dimensions of the jacket are so tight that the headlight is firmly held.

A further example of use is, as mentioned, a foldable cardboard blanks which corresponds to an unfolded parallelepipedic box with bottom and top.

Such boxes are normally processed on automatic packaging machines. For this reason the quality of the product leaving the folding machine is particularly relevant.

A foldable cardboard blank can be provided with the required slots or notches. For this purpose the corrugated cardboard sheet is slitted, or notched parallel to the undulations in the region of the folding grooves. The slot width equals e.g. 1 cm. The slot depth corresponds to the folding length of the bottom or top. In this way the bottom and top of the foldable cardboard are attached so as to be freely movable relative to the rest of the cardboard. Normally three slots can be precisely cut. A fourth slot is formed in the area of the two folded side flaps meant to be connected to each other. One of the two side flaps is additionally provided with a so-called adhesion border or glue border. This is a tongue which is also provided with a folding groove.

The folding grooves can form a hinge between the side flaps and the middle part. Normally for parallelepipedic boxes four folding grooves are provided. On each side of the middle section one folding groove is provided in addition to one folding groove within the middle part and one folding groove in the area where the two side flaps are brought together.

In such folding machines the optionally prestamped blanks are transported while at the same time the still flattened side flaps of the blanks with the already prepared folding grooves are seized and are tilted inwards during their ride along the conveyor path.

The folding takes place by means of so-called turning belts known per se, which at first seize the side flaps from underneath. The turning belts run from a level below the middle section to a level above the middle section. The axes of the turning belts are so arranged with respect to each other, that the belt surface turned towards the foldable cardboard blank turns by a total of 180 degrees along the conveying path. Therefore normally on both sides of the middle part two such turning belts are arranged in succession, each of the turning belts being staggered by only 90 degrees.

OBJECTS OF THE INVENTION

It is the object of the invention to keep at a minimum the tolerances of the inner dimensions of all foldable cardboards produced on the machine in one batch.

When the foldable cardboards are parallelepipedic boxes, wherein at the end of the folding grooves slot-like recesses are provided, then it is a secondary object of the invention to additionally provide the folding machine so that all slot widths of a foldable cardboard can be produced with equal dimensions.

SUMMARY OF THE INVENTION

These objects are attained in the known folding machine by including a scoring device as a component of the folding station, which engages the blank in that frontal area of the conveying path whereupon the side flaps are tilted inwards by at least 60 degrees from their flattened position, along the already available folding grooves, whereby the scoring device with the folding edges running in the longitudinal direction of the folding grooves lies linearly in the folding grooves so that there a limiting edge is formed along which the respective side flap is inwardly supported and guided during the tilting motion.

The invention provides an embodiment for achieving this object and a further development of this embodiment.

The embodiment is based on linearly restraining the already existent folding grooves with a concurrent inward tilting motion of the side flaps (=folding station).

The further development is based on the production of folding grooves which do not yet exist, by linearly restraining the blank (=grooving station) with a subsequent folding station.

The invention affords the advantage that, independent from the width of the folding groove, between side flap and middle section, for each side flap a folding groove precisely positioned within millimeter range and running along with the blank at the speed of the blank is offered. With regard to the blank, according to this invention the processing is static. In this way it is not only possible to eliminate the damaging and unpredictable dynamic influences, but also to produce excellent quality at high speeds.

The distance between the two folding grooves does not change over the entire conveying path. In the first embodiment, in addition to the linear restraining of the of the blank, each side flap is folded inwards.

The folding edges offer to the side flaps swung inwardly by e.g. the turning belts a guide supporting the grooved area from within, and where a tilting motion is forced with millimetric precision.

The invention uses the fact that such corrugated cardboard blanks—in relation to the basic dimensions of the blank—are always grooved in corresponding locations. However these folding grooves have a certain width, e.g. of 1 cm. By a "folding groove" one understands the width in the blank which normally is produced by means of so-called preliminary squeezing rollers. The blanks are guided through the gap of opposite rollers. This rollers are at the narrowest possible distance from each other, which is smaller than the thickness of the blank. In this way the blank is squeezed, in order to prepare it for the subsequent effectuation of the folding groove. This way a certain groove area results, wherein subsequently the actual hinge axis will be positioned.

It can be concluded that up to now, due to the inner structure of such corrugated cardboards, the precise geometric position of the actual hinge axis for the tilting motion was more or less left to chance.

Without the steps taken by the invention, the actual hinge axis lies merely somewhere within the width of the folding groove.

The scoring device as a separate grooving station eliminates this disadvantage due to the precise linear restraining of the blank over the entire blank length during grooving.

The scoring device together with a turning device (=folding station) eliminates this disadvantage due to the precise linear restraining of the blank during the simultaneous inward tilting motion of the side flaps.

The linear restraining of the blank by means of the scoring device is a characteristic feature of all embodiments of the invention. Thereby the restraining lines can also be realized in that the folding edge and the corresponding support zone seize the blanks in the manner of scissors or a stamp.

In practice it can be seen that folding grooves made in cardboard blanks, in spite of geometrically identical blanks, never lead to exactly corresponding inner dimensions. The cross section of the material in the area of the folding groove plays an important part, since there particularly the reinforcing effect of the undulations has an impact. The course of the undulation in various folding grooves is purely random, so that only the present invention creates uniform conditions for folding grooves.

So for instance in the case of corrugated cardboard an unintended and unpredictable displacement of the folding groove can take place depending on the course of the undulation. The folding groove occurred always there where the grooved blank had the least bending resistance.

Conventional grooving device (e.g. rollers running in opposite directions) do not prevent the blank from relaxing immediately after grooving, as soon as it is no longer subject to the force of the rollers. The punctiform engagement between the rollers takes care of the local deformation of the blank under high pressure, but can not be maintained downstream on the conveying path and has no effect upstream on the conveying path.

Here the invention is essentially different, in that the linear restraining of the blanks takes place statically at the blank, namely over the entire blank length. The grooving occurs due to a static displacement over the entire blank length. Therefore the displacement can occur purely laterally, and not in or against the conveying direction, as is the case with oppositely running rollers.

This problem arises particularly in the case of low cardboard strength.

In the case of preslotted blanks, this displacement of the actual folding zone within each folding groove can lead to different folding results with different slot widths in the area of the overlapping side flaps. This is where the inaccuracies in the geometric position of the actual folding zone within the folding groove have particularly serious effects. In the most unfavorable cases, the inaccuracies created in other locations can add up at this location.

In this connection it has been attempted to provide folding blades in the rear area of the conveying path, namely there where the side flaps are flapped between 90 and 180 degrees.

These are blade-like sheet metal strips located closely above the middle section of the foldable cardboard blank, whose outwardly pointed edges should lie in the folding grooves. The upstream ends are stationary. The downstream ends protrude freely. Thereby the free length can be up to two meters and more. It is therefore understandable if an already too narrowly prefolded cardboard blank is easily capable of pressing together the freely projecting blade ends. On the other hand defects on cardboard blanks which have been too widely prefolded, also can no longer be eliminated, since then the folding blade no longer have contact with the folding zones. In conclusion, a correction of any defective preliminary folding—too wide or too narrow—is not possible. Therefore the intended effect of precise cardboard guidance by means of these folding blades is strictly limited. On the other hand the free ends of the folding blades do not lend themselves to a stationary mounting, since in the area of the free ends the side flaps have to lie closed on the middle section, so that they can be glued together there.

The invention is totally different from this teaching known per se. The invention recognizes that a considerably enhanced precision can be achieved only through a precise execution of the folding groove or through precise initiation of a folding process with a folding zone defined with millimetric accuracy.

This is possible only in the frontal portion of the conveying path. In the frontal part of the conveying path, the side flaps are still flattened.

If there is a grooving station, the side flaps are worked into the blank while they are still in the flattened state.

In the case of the other embodiment (=folding station), the side flaps are tilted inwards from the flat position by at least 50 degrees during the restraining of the blank.

The geometrically exact processing of the blank (grooving or prefolding) in the frontal area of the conveying path is essential to the invention and needs no further correction.

Thereby the provided scoring device makes possible the precise positioning of the future folding zone in the folding groove already before the start of the folding process, independently from the respective cross section construction of the cardboard blank in the area of the folding groove. The scoring device engages namely directly in the folding groove. The undulation between the cover layers of the corrugated cardboard is therefore pressed flat, so that it is possible to achieve a uniform cross section for all folding grooves. Besides the folding edges of the scoring device extend along the conveying path at least so far that the folding zones can not be displaced on the remaining conveying path.

For this reason a precise guidance of the side flaps along the provided folding edges takes place in the frontal area of the conveying path, and changes no longer occur in the rear area of the conveying path.

It is sufficient to mount the scoring device only in the frontal area of the conveying path.

In a grooving station frontal area means that length portion of the conveying path on which the side flaps lie flatly.

In the other embodiment of the invention (=folding station) the frontal area defines that length portion wherein the side flaps are bent from their flat position up to at least where they form an approximately right angle.

The special advantage results from the following combination:

On the one hand the side flaps are still spread out widely on the frontal area of the conveying path. On the other hand only in the frontal area of the conveying path it is made possible to provide the scoring device also at the end side, i.e. downstream in conveying direction, so that the precise positioning of the folding edge in the folding groove is identical for all foldable cardboards produced on a folding machine.

In this way an unintended course of the folding groove (=hinge axis) on cardboards blanks, which are either too narrowly or to widely prefolded, is precluded.

What matters is that the two parallel folding edges, which engage in the folding grooves, maintain a constant distance from each other and define a plane which is parallel to the motion plane of the conveyed middle section. In this way a precise rectangular folding of the side flaps is forced.

As a result the smallest possible area of the folding groove becomes the hinge between the middle section and the side flaps. Thereby the position of the actual folding zone is fixed geometrically correct, which in the case of slotted cardboard blanks also increases the precision of the resulting slot width of the last slot.

Further it is essential that in the contact area between the folding edge, support area and foldable cardboard blank no relative motions occur in conveying direction. This avoids wear and in addition makes possible an increase of the contact pressure between the scoring device and the cardboard blank. The danger of overheating is also eliminated.

The scoring device of the invention is driven by a synchronous drive at such a speed that the processing of the cardboard occurs at the conveying speed of the cardboard. Thereby it is advantageous to avoid any slippage, so that it can actually be assumed that static conditions prevail at the blank.

Preferably the folding edges are realized by revolving endless chains, whose chain links point into the folding grooves with tongue-like, respectively web-like extensions.

Such endless chains are driven synchronously with the conveying speed.

Thereby it is advantageous when the tongue-like extensions form with their outer side facing the side flaps an angle of no more than 90 degrees, preferably no more than 70 degrees, with respect to the plane of the middle section. Also embodiments are conceivable wherein the folding edges are guided so far downstream in conveying direction until the side flaps are almost folded together. Thereby on the one hand the space available between the side flaps and the middle part, which becomes increasingly smaller due to the inwardly swung side flaps, is optimally used, and on the other hand a large proportion of the applied contact pressure is brought to bear on the foldable cardboard blank.

By contrast for a grooving station with web-like extensions it matters when the folding edge and the corresponding support zone are pressed as much as possible vertically against the blank, in order to translate a large proportion of the pressure force into the desired deformation of the blank in the area of the folding groove.

The features of claims 6 to 9 relate to a further improvement of product accuracy and serve especially for winging the side flap of the blanks inwards only as a result of those swinging forces which are not only equal and equidirectional between the frontal contact point and the rear contact point between side flap and turning belt, but also engage at the side flaps in such a manner relative to the folding groove, that the side edge of the side flaps to be swung inwards is kept in parallel with the folding groove, while the tilting motion is imparted to the side flap.

Thereby the particular advantage here is that the side flaps tilted inwardly in this manner are even then precisely tilted about the tilting axis in the folding groove, when the blank has already partially or totally left the area of the scoring device. Thereby the one and same tilting axis in the folding groove is maintained, independently from the engagement relationship between the scoring device and the blank, whereby tilting axes defined for both side flaps remain always parallel to each other. For this reason the foldable container is folded into a perfect parallelepiped.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
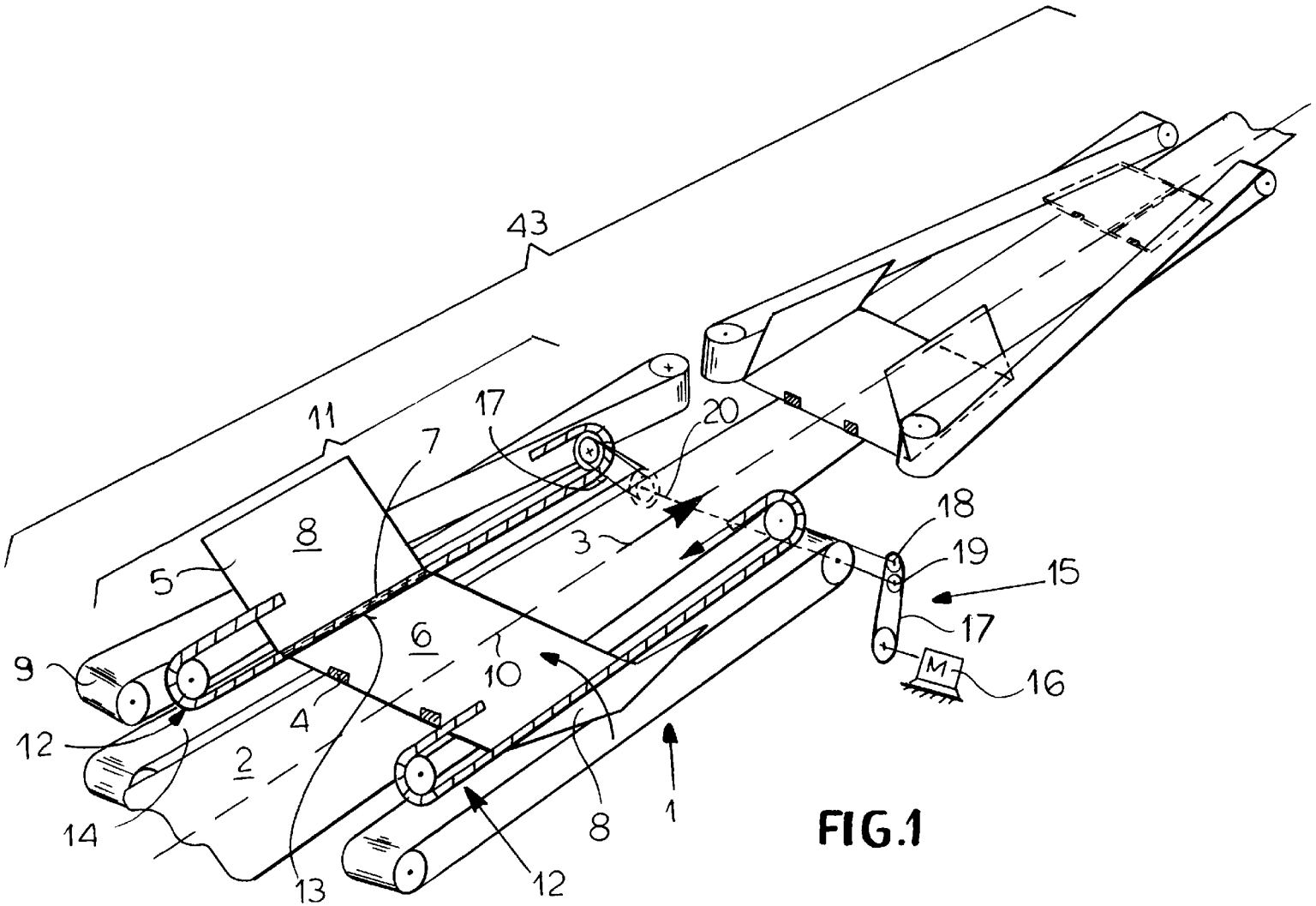
FIG. 1 is a perspective view of a folding machine.

The figures show a folding machine for producing foldable containers.

In principle such a folding machine consists of a central conveyor belt 2 (FIG. 1), which revolves endlessly with a conveying speed 3. The outward facing belt surfaces of the conveyor belt 2 offer a support surface for a foldable cardboard blank 5. This foldable cardboard blank lies on the central conveyor belt 2 and is firmly entrained in the conveying direction 3 by entrainment means 4 connected with the conveyor belt. Such a foldable cardboard blank has a middle section 6, which lies on the central conveyor belt 2. On both sides of the middle section laterally arranged folding grooves 7 are provided. The folding grooves are shown here in broken double lines running in longitudinal direction. The folding grooves 7 lie parallel to the conveying direction 3 and represent hinge-like connections between the middle section 6 and the respectively pertaining side flap 8. Along this hinge-like folding groove, the side flaps 8 can be swung inwards with respect to the longitudinal median 10 of the blank 5. For this purpose serve so-called turning belts 9, which are substantially parallel to the central conveyor belt 2. These are endlessly revolving flat belts, which over the entire conveying path ascend from a level below the central conveyor belt 2 to a level above the central conveyor belt 2, nevertheless slightly converging in the direction of the central conveyor belt 2 and which at the same time face upward with their outer belt surface at the beginning, while at the end of the conveying path they face downwards, i.e. towards the central conveyor belt 2. On each of these outer belt surfaces rests one of the side flaps 8. The side flap 8 has to follow the turns of the belt and thereby it is at first lifted from its spread-out position, increasingly swung along the folding grooves towards the inside, i.e. the longitudinal median of the blank and finally folded together from above with the opposite flap 8 and connected thereto.

Figure 9:
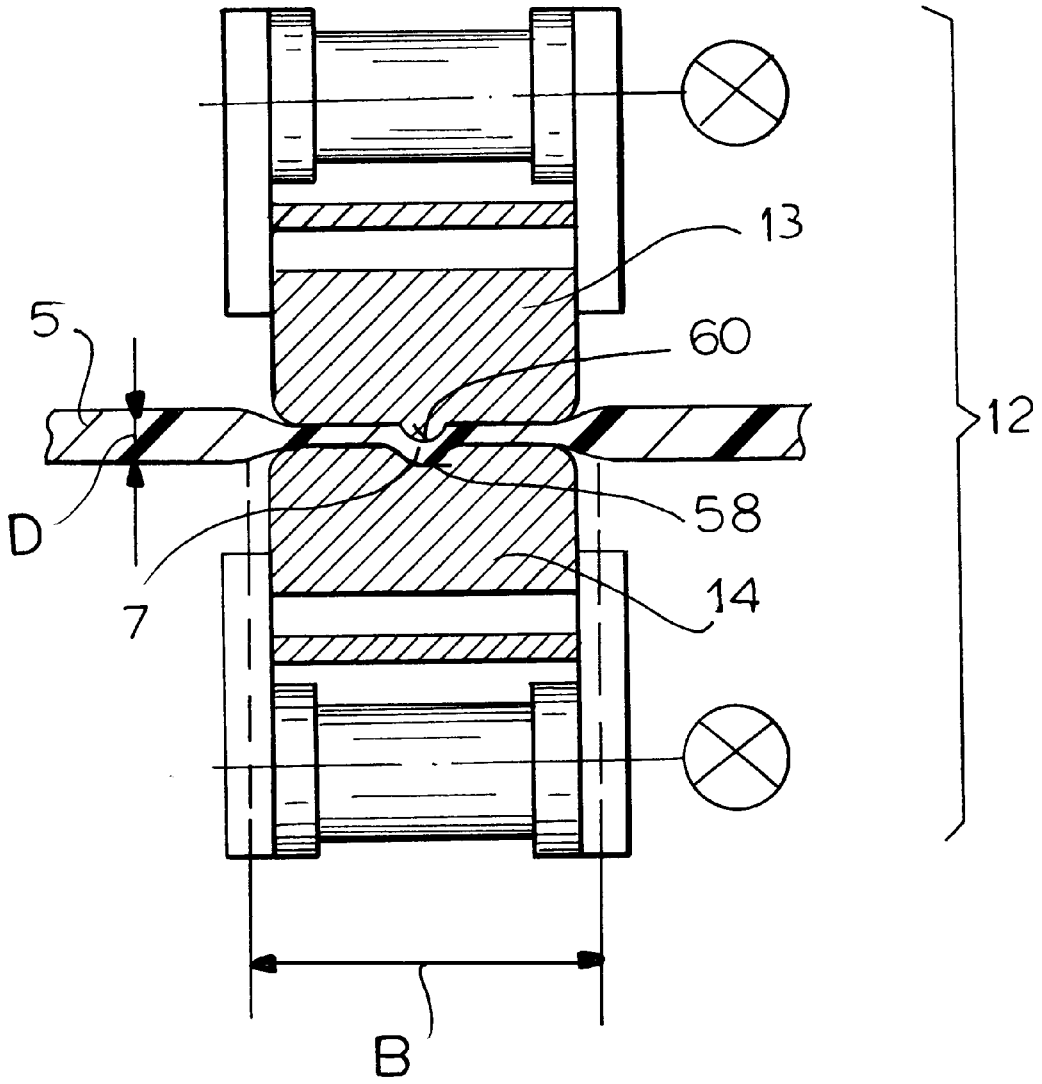
FIG. 9 a special embodiment of the scoring device for a grooving station according to FIG. 8.

In this way in such a folding machine an annular closed foldable container with at least two mutually parallel folding grooves is produced from a flat laid out container blank. It is now conceivable that the folding grooves 7 have also a certain transverse extent, which according to FIG. 9 is also named folding groove width B.

This transverse extent can for instance lie within the range of 1 cm. Thereby the actual folding zone can lie somewhere within the folding groove 7.

Figure 8:
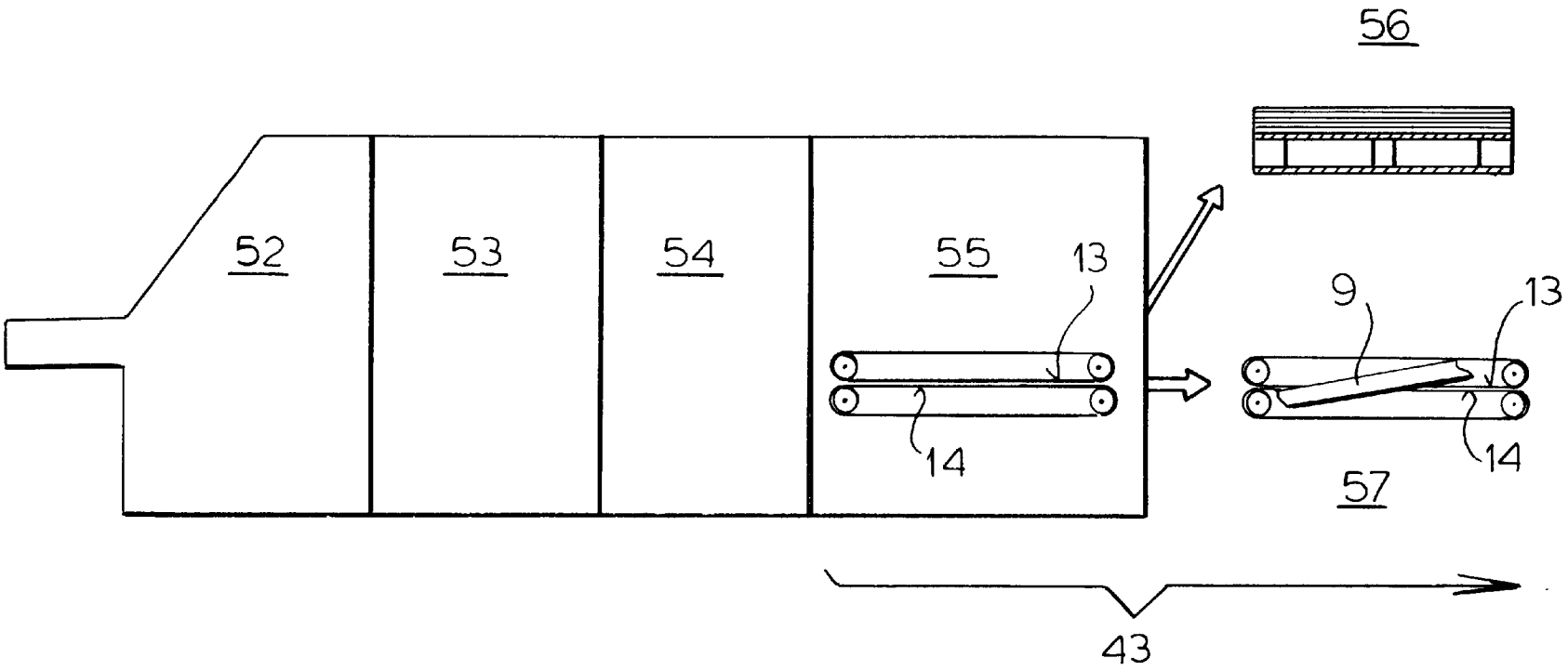
FIG. 8 is a diagrammatic view of a folding machine with grooving station.

Therefore the actual folding zone is established at random, unless additional steps for the initiation of the folding process at predetermined locations are taken (see FIG. 1) or unless the folding grooves are made with millimetric precision in the blank and established there in advance (see FIG. 8).

According to the invention for these purposes a scoring device is provided in the frontal area 11 of the entire conveying path. This scoring device 12 consists of a folding edge 13 located above the blank 5 and of a support zone 14 corresponding to the folding edge and located under the blank.

The folding edge 13 arranged above the blank lies linearly on the blank 5 in the longitudinal direction of the folding groove 7. The line lies within the preset width of the folding groove 7. According to the embodiment of FIG. 1, in this weakened area of the blank a limiting edge is offered, at which the side flap 8 can be tilted inwards with millimetric precision, while at the same time it is moved forward by the central conveyor belt 2.

For this purpose the blank 5 is pressed by the linear folding edge 13 against the corresponding support zone 14 with a predetermined force. As a result the blank 5 is linearly restrained in a predetermined position within the folding groove 7 by the respective scoring device 12 provided there. The predetermined distance of the restraining zone remains unchanged due to the arrangement of the scoring device 12 on the machine frame, so that for the entire lot of foldable containers produced on this folding machine the identical inner dimensions can be expected.

Further it is essential for both embodiment examples that in each of them the scoring device 12 be driven synchronously with the conveying speed 3. For this purpose serves a drive 15 for the scoring device 12.

The drive 15 consists here of the central machine motor 16. This machine motor normally drives all units of such machines. These driving means are not illustrated for the sake of a clear overview. However it is important that all drive lines be coupled via slippage-free mechanical connections, in order to achieve a synchronized movement of all parts.

In addition to the machine parts not shown in the drawing, in the present case the motor 16 drives via a common chain 17 the pinions 18, 19 with equal diameter, one of which (18) drives the folding edge 13 and the other one (19) drives the corresponding support zone 14. Via a transverse driving axle 20 the rotary motion of the drive 15 is transmitted to the oppositely located scoring device 12. Via an additional connection chain 17 on this side the motion of the corresponding support zone 14 is also synchronously coupled with the motion of the folding edge 13.

This applies also to the embodiment according to FIG. 8 with separate grooving station.

For the sake of a better overview in the representation of FIG. 1 the frontal turning belt running on the right side of the blank is not shown. But from the twist of the turning belt 9 shown on the left side it can be seen that the outer side of the turning belt is turned inwardly clockwise by 90 degrees from an initial horizontal direction up to a vertical direction.

Accordingly the frontal area of the conveying path 11, which is characteristic for this invention, lies there where the side flap 8 is swung inwards from its initial, essentially spread-out position (=180 degrees) at least so far that the angle between the side flap 8 and the middle section 6, whose point lies in the folding groove 7 does not surpass 120 degrees.

It is not necessary that the scoring device 12 engage the blank immediately at the start of the tilting process. However it is essential that in each and every case the angle of tilt—calculated from the spread-out position of the blank—be of at least 60 degrees. Thereby it is presumed that with such an angle of tilt the folding zone is already so precisely set within the folding groove 7, that an unintended displacement of the folding zone (=hinge axis) predetermined with millimetric precision can no longer take place.

Since also mechanical parameters, such line width, clamping force, cardboard strength come into play, and particularly since the blank is not allowed to be destroyed in the area of the folding groove, these influencing factors have to be considered when limiting the exact angle range. In any case under normal circumstances an inward tilting angle of 60 degrees can already insure the desired precision of the inner dimensions.

Furthermore it has to be clearly stated that the folding edge has to engage linearly in the folding groove, but this is in no way a limitation of the invention to uninterrupted linear contact zones between folding edge and folding groove. What is essential here is to insure that linear course of the folding edge be of such length as to avoid an unintended displacement of the folding zone.

Figure 2:
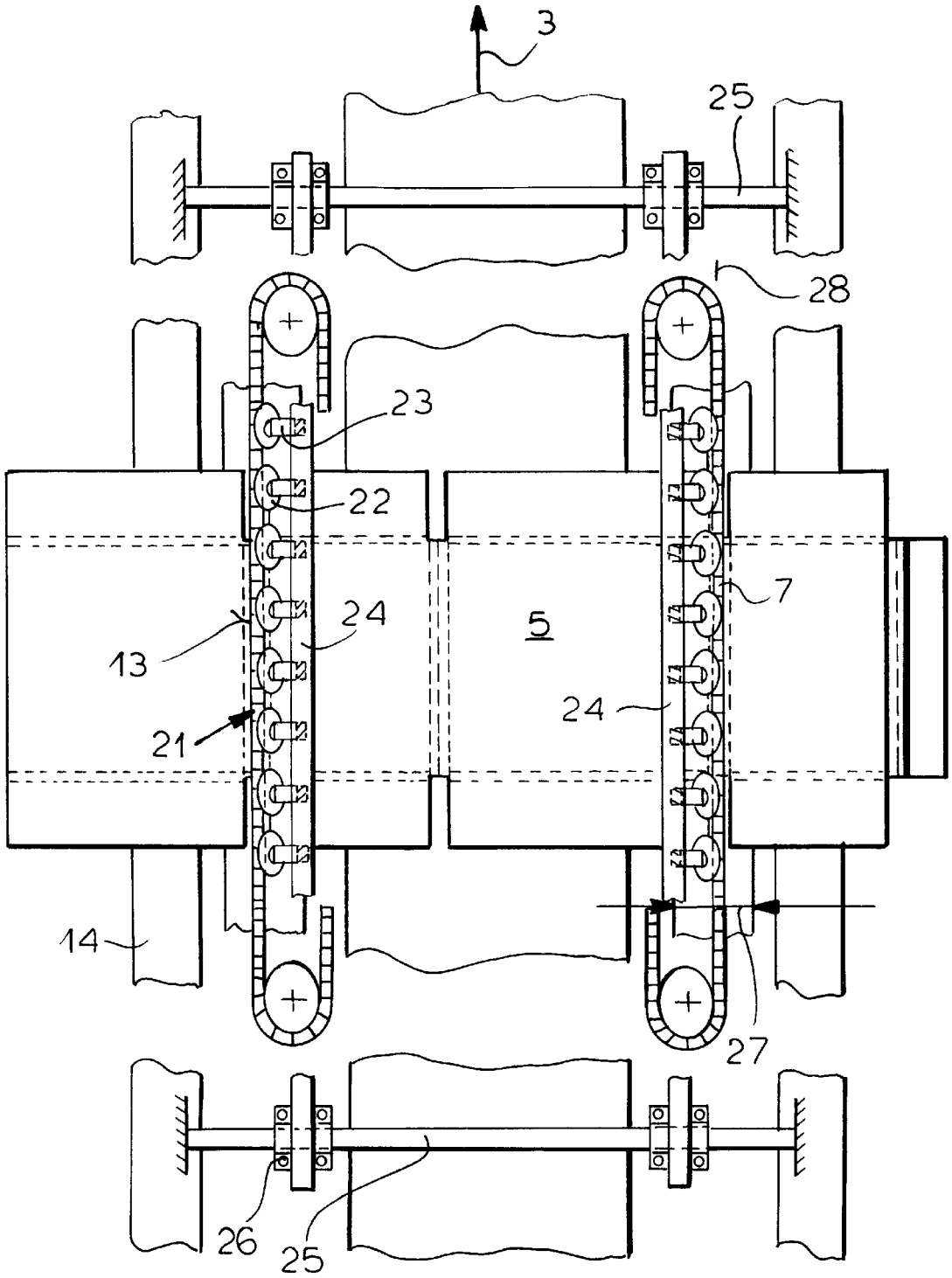
FIG. 2 is a plan view of the frontal area of a folding machine according to FIG. 1.

In addition the FIG. 2 shows that the folding edge is formed by a continuously revolving chain. Thereby the chain side forming the folding edge 13 is actuated from the opposite chain side with a chain pressing device 21. This chain pressing device 21 has sliders 22 along the folding edge 13, which are mounted on thereto assigned holders 23. A multitude of such holders 3 with sliders 22 are arranged on a common carrier 24.

Thereby a pressure zone is obtained along the chain line, in order to push the folding edge 13 into the folding groove 17 with predetermined force. By means of a mounting 26 each carrier 24 is adjustable transversely to the conveying direction 3 to allow for a distance modification from the respectively opposite carrier 24. This way the scoring device 12 is adjusted to different blank sizes. Special care has to be taken to maintain the position of the folding edges parallel to each other, and as much as possible in a common plane. The common plane lies parallel to the plane of the blank 5.

In order to make sure that the folding is as accurate as possible, it is further proposed to position the folding edges precisely in the longitudinal median 28 of the folding grooves 7. There by applying the aforementioned steps the lowest resistance moment during the tilting motion of the side flaps can be expected.

As can be further seen from FIG. 2, the corresponding support zones 14 have a certain width 27, so that on both sides of the folding edges 13 a border strip remains free. Therefore when the distance between the carriers 24 is changed, it is sufficient to leave the position of the corresponding support zone 14, namely of the support belt, unchanged. For this further development of the invention the entire width 27 of the flat belt can be actually considered as a corresponding support zone 14.

Figure 3:
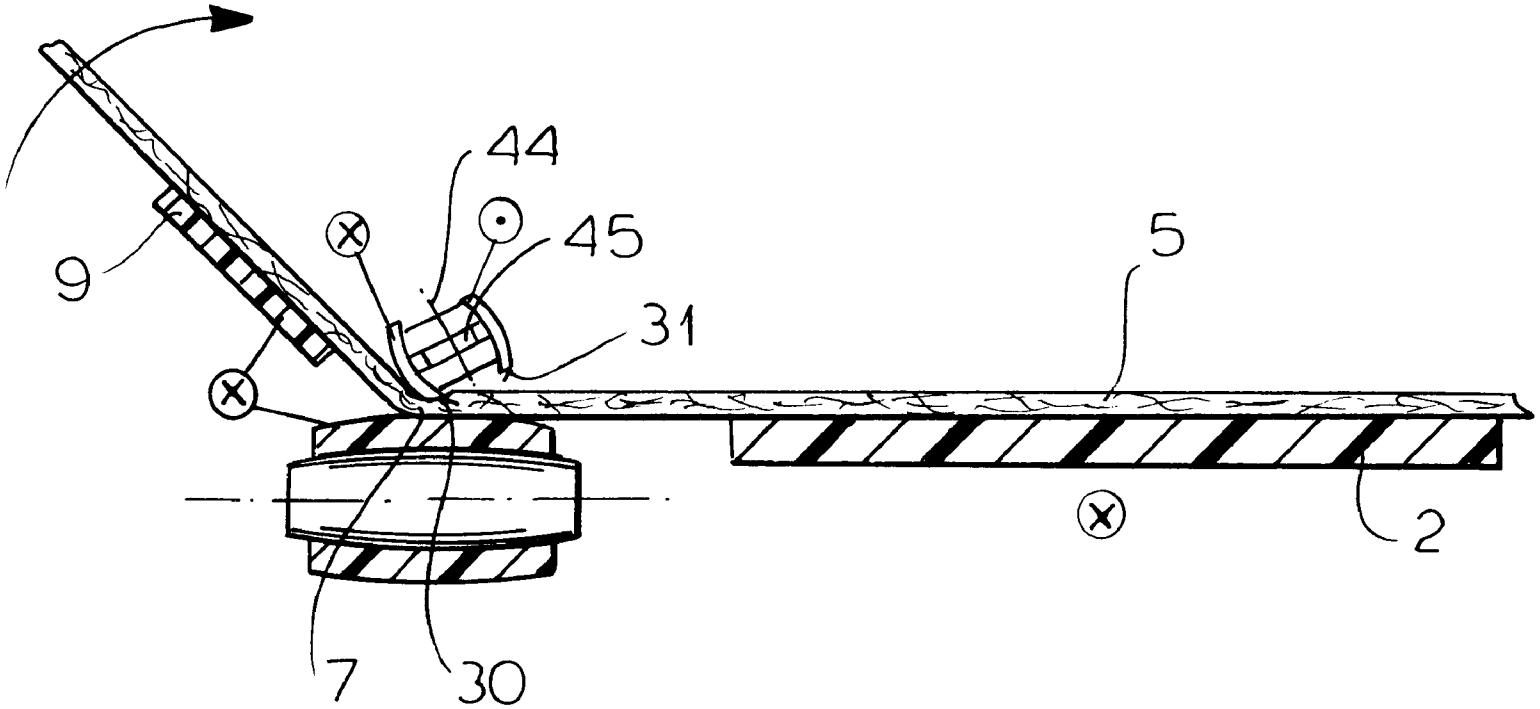
FIG. 3 is a top view of a folding machine according to FIG. 1.

Further FIG. 3 shows that the folding edge can be formed by the belt edge of a revolving folding belt. This is a flat belt. The axis 44 of the belt guide roller 45 is slightly inclined with respect to the plane perpendicular to the plane of the blank. Preferably this is a so-called tracking cog belt which in a certain way is capable of absorbing lateral forces, without being displaced from its running plane. The projections provided on such belts engage in a manner known per se in corresponding recesses designed as snap-ring-like grooves on the guide rollers 45. This way a certain contact pressure between the folding belt edge 30 and the folding groove 7 can be established. As a result of the slight inclination of the belt axis 44, the belt side running against the conveying direction can run with its free belt edge 31 past the blank without making contact. Besides this representation corresponds to the representation according to FIGS. 1 and 2. Reference is made to the preceding description regarding the features which are not specifically mentioned.

Figure 4:
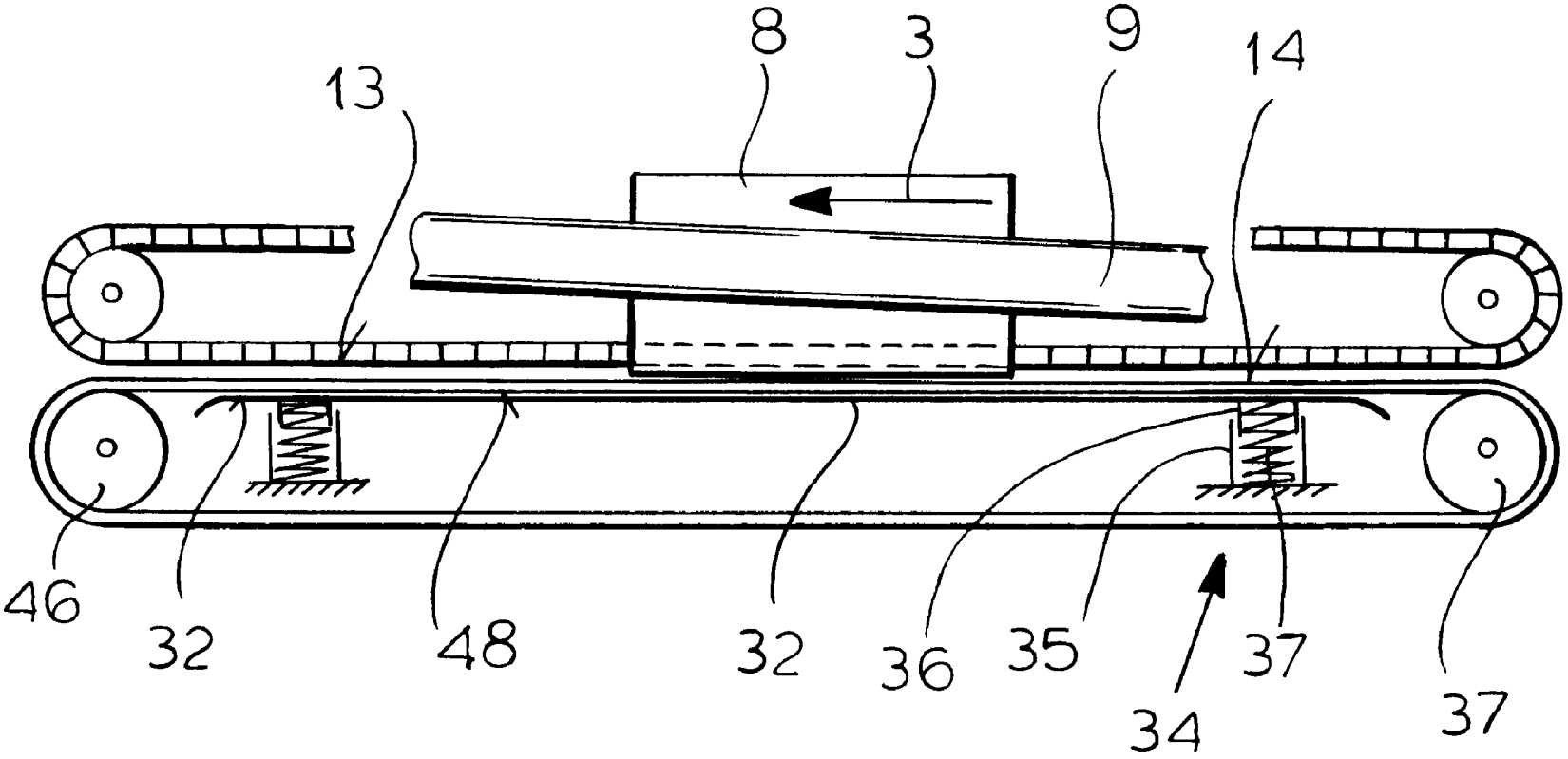
FIG. 4 is a side view of a folding machine according to FIG. 1.
Figure 5:
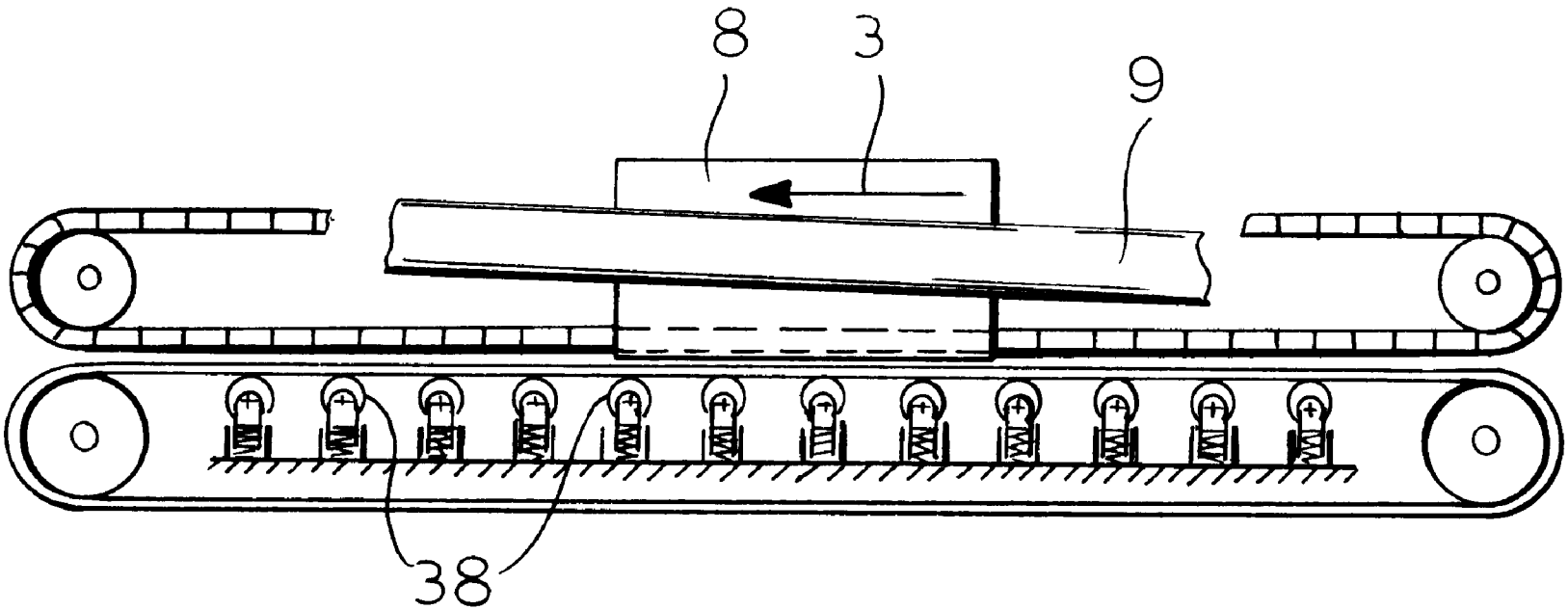
FIG. 5 is a side view of a folding machine according to FIG. 1.

Furthermore FIGS. 4 and 5 show another development wherein between the end side guide rollers 46, 47 of the belt side forming the support zone, on its underside 48 guiding devices 32 are provided, by means of which the belt side is pressed against the underside of blank 5.

In the case of FIG. 4 the guiding device consists of a guide rail 33, which is supported on elastic mountings 34. These elastic mountings consist on the one hand of a stationary receiving element 35, as well as of a rail counterpiece 36 which is longitudinally adjustable in the receiving element. The counterpiece is elastically supported with respect to the stationary receiving element by means of a spring 37 and presses with predetermined force against the underside of the belt side forming the support zone 14, while at the same time the folding edge 13 is held in the opposite direction. In this way along the folding groove 7 a predetermined pressure force results which remains constant over the entire length of the frontal area of the conveying path.

However particularly for higher speeds the guide rollers 38 (FIG. 5) are appropriate. The guide rollers 38 are arranged along the underside of the belt 14 forming the support zone and press in the same elastic manner against the underside of the belt 14. In addition due to these steps friction is avoided, wear is reduced and still an essentially constant contact pressure force is insured in the area of the folding groove.

Figure 6:
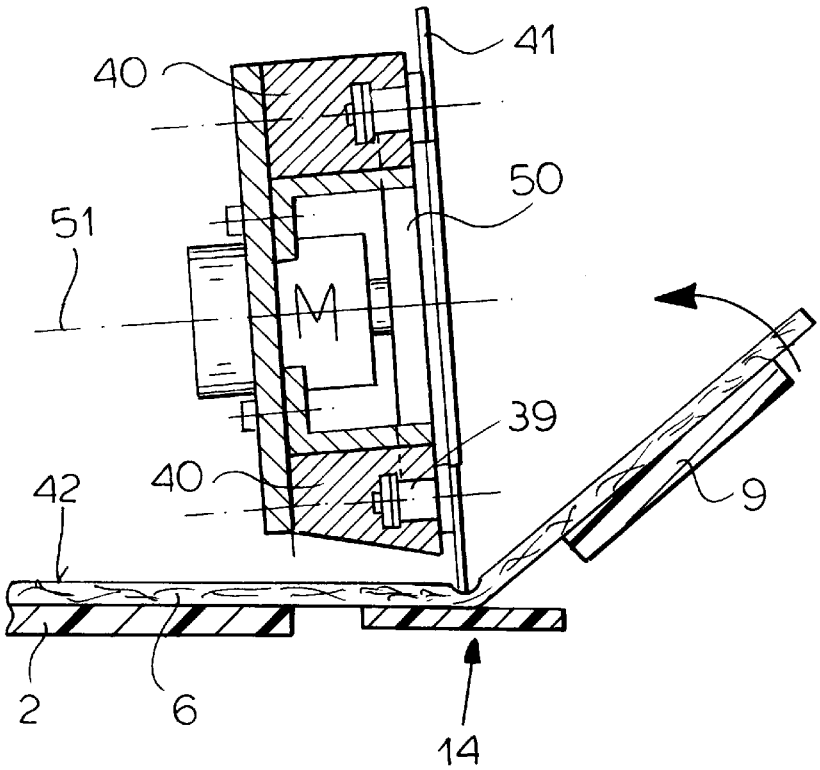
FIG. 6 is a detail sectional view of a scoring device with a revolving endless tongue chain (upright running plane)
Figure 7:
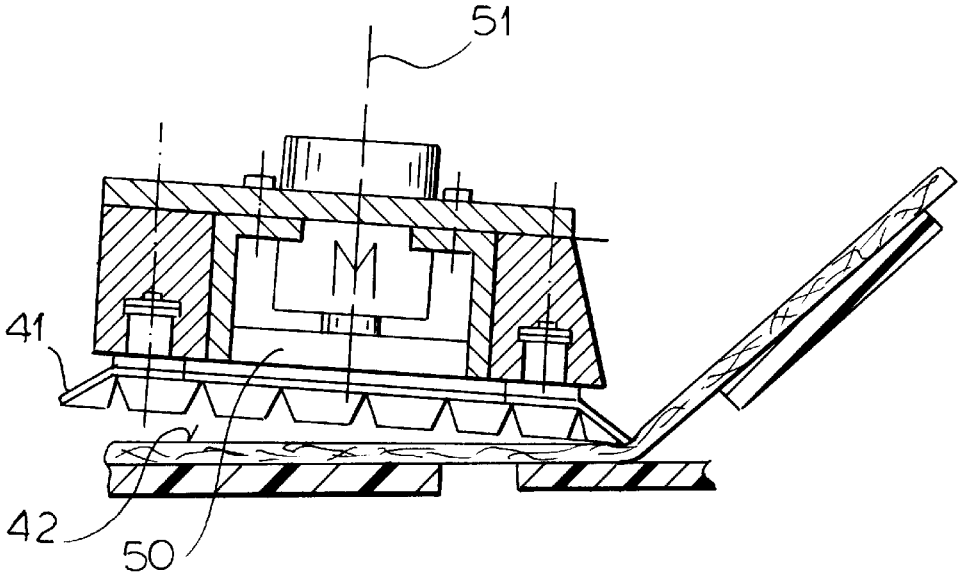
FIG. 7 is a detail sectional view of a scoring device with a revolving endless tongue chain (horizontal running plane)

Further FIGS. 6 and 7 show that the folding edges 13 are formed by the transverse tongues of an endless chain 39 revolving with conveying speed. This endless chain 39 lies in a recess corresponding to the outer chain contour of a respective chain guide rail 40. This chain guide rail 40 is a commercially available component and sits on a common carrier 49, which in turn is fastened to the machine frame.

At each end of the chain guide rail 40 a sprocket 50 is arranged, one of which is set into rotation by the motor 16. The chain guide rail extends along the frontal area of the conveying path. The recess in the chain guide rail is narrowly fitted to the outer contour of the chain links. As a result the transverse tongues 41 follow exactly the linear path of the recesses along the frontal area of the conveying path. This way it is possible to establish a substantially constant contact pressure between the folding edge 13 and the folding groove 7, respectively the support zone 14.

In addition guiding devices/chain guiding rails can be actuated by hydraulic cylinders. This offers the advantage of a pressure force between the folding edge and the corresponding support zone, which does not depend on groove strength or cardboard quality.

In the case of FIG. 6 the axes 51 of the sprockets are substantially parallel to the plane 42 of the blank 5. However, in order to prevent a premature collision with the inwardly folded lateral flaps 8, the axes 51 can be slightly inclined towards the longitudinal median 10 of the blank 5. But in any case the axes are also arranged perpendicularly to the conveying direction 3, in order to prevent relative movements between the transversal tongues 41 and the blank 5. In such arrangements of the axis 51 the transversal tongues 41 point radially outward with respect to the axis 51.

The embodiment according to FIG. 7 differs from that of FIG. 6 in that here the axes 51 of the end-side sprockets 50 are substantially perpendicular to the plane 42 of the blank 5, whereby the transversal tongues 41 are now angled so far as to be substantially parallel to the axes 51, i.e. between exactly parallel and positively inclined outwards (FIG. 7) and pointing towards the blank 5.

FIG. 8 shows that the scoring device of the invention is also suited to function as a separate station 55 for producing the folding grooves. Such use has to be clearly included.

In such a folding machine a feeding station 52, optionally an inking station 53, a slitting station 54 are arranged in succession in the conveying direction 3. Then a grooving station 55 can be provided, by means of which the incoming flat blanks are grooved in conveying direction. For this purpose serve scoring devices such as have been previously described. However in this case the inward tilt of the side flaps does not take place, so that the pregrooved flat blanks are transported to a stack 56.

Thereby especially such embodiments have to be considered wherein the support zone 14 forms a longitudinal groove 58, which is flanked by one or two raised longitudinal areas 59. The folding edge forms with a longitudinal web 60 the counterpiece to the longitudinal groove, which basically lies oppositely from the longitudinal groove 58 (see FIG. 9). The longitudinal web 60 can be pressed precisely fitting into the longitudinal groove 58, so that the blank is linearly restrained and simultaneously is at least temporarily grooved in a static manner.

It can be seen here that the distance between the folding edge 13 and the corresponding support zone 14 is smaller than the thickness D of the blank. In this way in this area the blank is flattened, while narrowing down the side area. The narrowing down occurs continuously, so that in the end the width B of the folding groove can not be precisely established. However the width B of the folding groove substantially covers the narrowed area.

Thereby also a subsequent folding station 57, as previously described, can be provided.

Figure 10C:
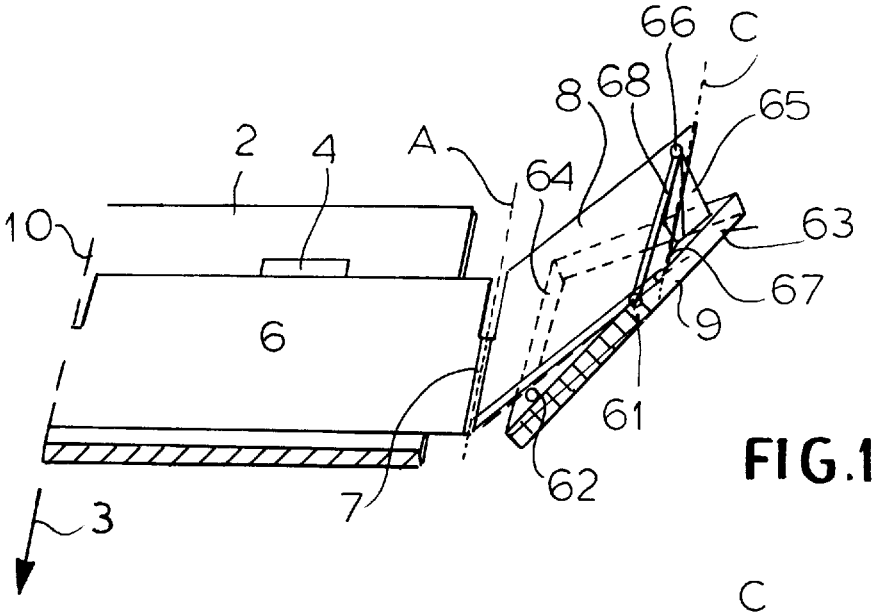
FIGS. 10*a*–10*c* are diagrams of engagement relations between turning belts and side flaps of the blanks.
Figure 10B:
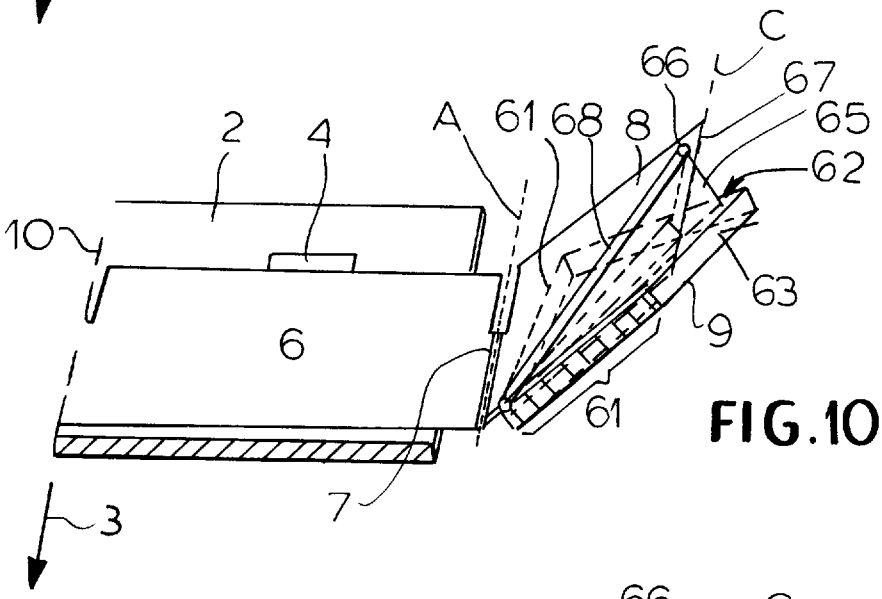
Figure 10A:
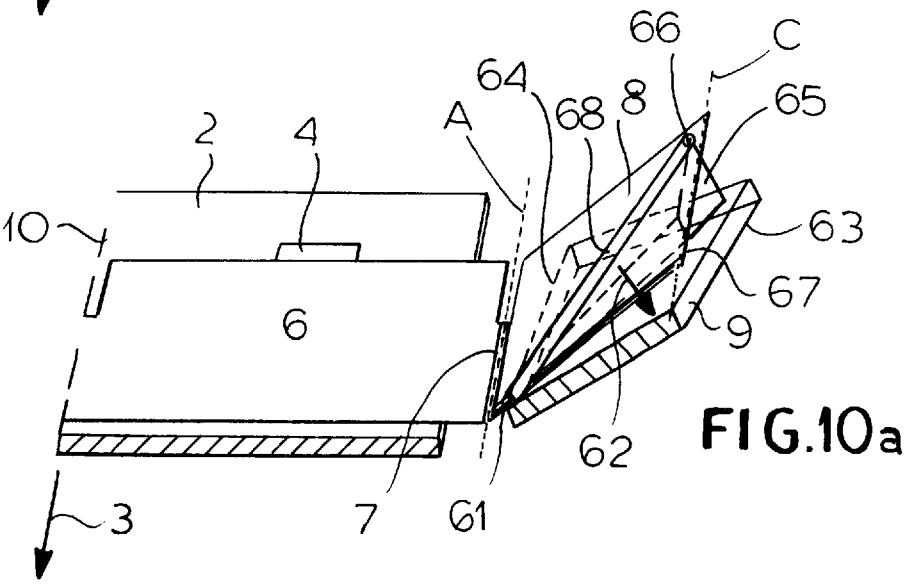

In addition thereto the FIGS. 10*a* to 10*c* show a further development of the invention, which is suited for folding the side flaps 8 of the blank 5 in such a manner that practically a parallelepipedic foldable cardboard box is formed.

At first the segment of a conveyor belt 2 moving in the travel direction 3 is shown. On the conveyor belt 2 lies the middle section 6 of the blank and is entrained in the conveying direction by the entrainment element 4 engaging at its rear edge.

The folding grooves 7 have already been made by the scoring device. But the scoring device can also still be located in folding grooves 7. Due to the constantly forward moving central conveyor belt 2, along the conveying path the existing folding grooves 7 sweep over a so-called travel zone which forms a geometric travel line. The middle section 6 is moved within this travel line, whereby the side flaps 8 have now to be folded inwards. For this purpose serve the turning belts 9, their respective longitudinal segment which at the moment cooperates with the side flaps being shown. With respect to the linear folding areas of the folding grooves 7, the turning belts ascend from their underside to the upper side and run towards each other from the outside to the inside, as also shown in FIG. 1.

Therefore as a rule the turning belts are not exactly parallel to the side flaps 8. The belt outer sides 62 converge in any event with the frontal edges of the side flaps 8 emphasized in the drawing and rest against them. Independently from the respective belt geometry, frontal contact points 61 result, which according to FIG. 10*a* can be located on the belt edge 64 facing the folding groove 7, but which according to FIG. 10*b* can extend over the entire belt width, or according to FIG. 10*c* can be located on the belt edge 63 facing away from the folding groove 7.

Therefore the essential difference between FIGS. 10*a* to 10*c* consists in the various possible contact points 61 between the belt outer sides 62 and the frontal area of the side flaps 8 emphasized in the drawing. Due to the fact that axes of the belt guide rollers (see FIG. 1) are arranged at certain angle to each other, a preset geometric position results for the side flaps 8 with respect to the outside of the turning belts 9. In any event the presumption is that in the rear area of the side flaps 8 no direct contact between the belt outer side 62 and the outside of the side flaps 8 can take place.

Thereby one of the belt edges, here 64, is closer to the outside of the side flap 8 than the other belt edge (here 63).

In order to insure now that the side flaps 8 rest against the turning belt 9 in an as clearly as possible defined geometrical position, on one of the belt edges 63, 64 a projection 65 is provided.

In a preferred embodiment this projection should be located on the further distanced belt edge 63, in order to obtain a favorable lever distance with respect to the folding groove 7 forming the hinge axis for the inward tilting of the side flaps 8.

The characteristic feature consists in that the projection 65 rises so far above the belt outer side 62, that the side flap 8 is guided so as to rest there too with its rear area. In this way in addition to the frontal contact area 61 a rear contact area 66 is created, which with respect to the folding groove 7 preferably engages with a greater lever arm at the side flap 8. In addition to the requirement that the side flap 8 also rest against the rear contact area 66, it must be insured that the inwardly swung lateral edge 67 is kept exactly parallel to the folding groove 7, while the blank is driven in conveying direction and while the side flap 8 is thereby swung inwards.

The FIGS. 10*a*–10*c* each show a geometric line A representing the tilting axis in the folding groove 7, as well as a line C which coincides with the inwardly swung lateral edge 87 [sic]. The lines A and C are here shown as precisely parallel. As a result of the height selected from the projection 65, the side flap 8 is supported in such a way that the line C lies exactly parallel to line A. The continuously inwardly swinging turning belt 9 thereby practically insures this parallel position as long as and while the side flap 8 is inwardly folded from its flattened position up to the final position of the blank (see FIG. 1).

As a rule the frontal contact point 61 and the rear contact point 62 rest against the side flap only spotwise, in order to prevent the transversal dislocation of the of the impact point between the turning belt and the side flap during the inward tilting motion.

If besides that it is intended to prevent a lateral bending of the side flaps 8, it is additionally proposed to connect the frontal contact point 61 and the rear contact point 66 with a common envelope 68, which should also rest linearly against the side flap 8. For instance this can be achieved by arranging continuously smaller projections 65 starting from the rear contact point 66 to the frontal contact point 61, whose contact points with the side flaps 8 should respectively lie on the envelope 68. Here too a merely punctiform contact is preferred, so that in the ideal case the envelope 68 is merely a line.

It is particularly preferable when the envelope 68 runs diagonally from the rear contact point 66 over the turning belt 9 up to the frontal contact point 61. However this is not a condition. Basically what matter is that the height of the projection 65 be selected so that the lateral edge 67 of the side flap 8 is exactly parallel to the folding groove 7, when the side flap 8 is supported on the projection 65.

Further it also does not matter if the length of the side flap 8 matches the length of the envelope 68. The envelope 68 can rather be longer than the side flap 8. In this manner such a turning belt becomes indispensable for processing the foldable cardboard blanks with various dimensions.

What is claimed is:

1. An apparatus for processing a blank, comprising:

a conveyor for displacing a blank along a conveyor path with a predetermined conveying speed, said blank being adapted to be folded into a cardboard container and having a middle section with adjoining side flaps foldable relative to said middle section along lines extending in a direction of displacement of said blank along said path;

folding belts along side said conveyor and shaped so as to displace said side flaps about said lines relative to said middle section inwardly toward said middle section;

a scoring device lying along an upstream part of said conveyor in the region of said folding belts and including an endless scoring member having an edge pressing against said blank along each of said lines and displaceable synchronously with said conveyor; and means forming a respective supporting surface beneath each of said lines for supporting the blank beneath the respective edge, said folding belts being oriented to impart an angle between said side flaps and said middle section between 60° and 110° in a region in which said blank is engaged by said scoring devices, each edge being formed by the edge of a belt having an outer belt side lying out of contact with said blank and forming the respective first traction element.

2. The apparatus defined in claim 1, further comprising grooving means upstream of said scoring devices for forming a folding groove in said blank along each of said lines, said edges of said scoring devices engaging in said grooves.

3. The apparatus defined in claim 2 wherein said grooving means is a separate unit arranged between a feeding station for said blanks and a folding station provided with said conveyor, said folding belts and said scoring devices.

4. The apparatus defined in claim 1 wherein said support is formed by a broad side of a belt.

5. The apparatus defined in claim 4 wherein the belt forming said support is provided with elastically supported rollers in a region in which side blank is engaged by the respective edge.

6. The apparatus defined in claim 4 wherein the belt forming each support is pressed from below by an elastically supported guide rail.

7. An apparatus for processing a blank, comprising:

a conveyor for displacing a blank along a conveyor path with a predetermined conveying speed, said blank being adapted to be folded into a cardboard container and having a middle section with adjoining side flaps foldable relative to said middle section along lines extending in a direction of displacement of said blank along said path;

folding belts along side said conveyor and shared so as to displace said side flaps about said lines relative to said middle section inwardly toward said middle section;

a scoring device lying along an upstream part of said conveyor in the region of said folding belts and including an endless scoring member having an edge pressing against said blank along each of said lines and displaceable synchronously with said conveyor; and means forming a respective supporting surface beneath each of said lines for supporting the blank beneath the respective edge, said folding belts being oriented to impart an angle between said side flaps and said middle section between 60° and 110° in a region in which said blank is engaged by said scoring devices, each of said edge being provided on a respective first traction element and said support being formed by an endless second traction element synchronized with the endless first traction element of the respective edge, each of said edges being formed by a multiplicity of transverse tongues of a respective endless chain forming the respective first traction element and having chain links.

8. The apparatus defined in claim 7 wherein said endless chain runs between sprockets having axes substantially parallel to a plane of the blank and perpendicular to said direction, said transverse tongues pointing away from the chain links of said chain radially outwardly with respect to said axes.

9. The apparatus defined in claim 7 wherein said endless chain passes between sprockets having axes substantially perpendicular to a plane of said blank and said transverse tongues extended generally in the direction of said axes and point toward said blank.

10. The apparatus defined in claim 7, further comprising means for adjusting a distance between said conveyor and each of said scoring devices.

11. The apparatus defined in claim 7, further comprising grooving means upstream of said scoring devices for forming a folding groove in said blank along each of said lines, said edges of said scoring devices engaging in said grooves.

12. The apparatus defined in claim 11 wherein said grooving means is a separate unit arranged between a feeding station for said blanks and a folding station provided with said conveyor, said folding belts and said scoring devices.

* * * * *